US009045970B1

(12) United States Patent
Riley, Jr. et al.

(10) Patent No.: US 9,045,970 B1
(45) Date of Patent: Jun. 2, 2015

(54) METHODS, DEVICE AND COMPONENTS FOR SECURING OR COUPLING GEOPHYSICAL SENSORS TO A BOREHOLE

(75) Inventors: Duncan W. Riley, Jr., Houston, TX (US); Russell Roundtree, Washington, PA (US)

(73) Assignee: Global Microseismic Services, Inc., Missouri City, TX (US)

( * ) Notice: Subject to any disclaimer, the term of this patent is extended or adjusted under 35 U.S.C. 154(b) by 438 days.

(21) Appl. No.: 13/302,718

(22) Filed: Nov. 22, 2011

(51) Int. Cl.
*E21B 33/122* (2006.01)
*E21B 47/01* (2012.01)
*E21B 33/124* (2006.01)

(52) U.S. Cl.
CPC ..... *E21B 47/011* (2013.01); *E21B 33/124* (2013.01); *E21B 33/122* (2013.01)

(58) Field of Classification Search
CPC ..... E21B 33/12; E21B 33/13; E21B 33/14; E21B 33/122; E21B 33/124; E21B 47/00; E21B 47/011; E21B 47/01
USPC ..... 166/250.17, 378, 101, 100, 285, 177.2; 73/152.57, 152.58; 181/105, 108, 111, 181/112
See application file for complete search history.

(56) References Cited

U.S. PATENT DOCUMENTS

| | | | | |
|---|---|---|---|---|
| 2,769,498 | A * | 11/1956 | Huber | 166/66.4 |
| 4,534,020 | A | 8/1985 | O'Brien | |
| 4,775,009 | A | 10/1988 | Wittrisch et al. | |
| 5,027,918 | A | 7/1991 | Cole | |
| H1156 | H * | 3/1993 | Siegfried, II | 367/31 |
| 5,206,840 | A | 4/1993 | Cobbs et al. | |
| 5,265,680 | A | 11/1993 | Withers et al. | |
| 5,452,763 | A * | 9/1995 | Owen | 166/259 |
| 5,503,225 | A | 4/1996 | Withers | |
| 5,524,709 | A * | 6/1996 | Withers | 166/250.1 |
| 5,529,123 | A * | 6/1996 | Carpenter et al. | 166/293 |
| 5,607,015 | A | 3/1997 | Withers et al. | |
| 5,771,170 | A | 6/1998 | Withers et al. | |
| 5,864,099 | A | 1/1999 | Wittrisch et al. | |
| 5,926,437 | A | 7/1999 | Ortiz | |
| 5,934,373 | A | 8/1999 | Warpinski et al. | |

(Continued)

OTHER PUBLICATIONS

Design and Installation of a Permanent Three-Component Geophone String at an Aquifer Storage and Recovery Site; Beenyup Western Australia. Harris et al. Date Unknown.

(Continued)

*Primary Examiner* — Jennifer H Gay
*Assistant Examiner* — David Carroll
(74) *Attorney, Agent, or Firm* — Edward E. Thigpen

(57) ABSTRACT

Disclosed herein are various embodiments of devices, methods and systems for securing or coupling a string of downhole geophysical sensors to the sidewall of a borehole, using an expandable member configured to be deployed into an expanded position when at least one geophysical sensor is located at a desired depth in a borehole, the expandable member being configured to engage at least portions of the sidewalls and prevent the passage of a securing or coupling material around or through the geophysical sensor when the securing or coupling material is poured around the geophysical sensor when the expandable member is in the open or expanded position. This allows the securing and acoustic coupling of downhole geophysical sensors to the sidewall of a borehole while avoiding problems caused by transmission of surface noise into the subsurface resulting from pouring securing or coupling material to fill the entire well bore.

13 Claims, 5 Drawing Sheets

(56) References Cited

U.S. PATENT DOCUMENTS

| | | | | |
|---|---|---|---|---|
| 5,963,508 | A | 10/1999 | Withers | |
| 6,230,800 | B1 | 5/2001 | Bryant | |
| 6,896,074 | B2 * | 5/2005 | Cook et al. | 175/50 |
| 7,322,422 | B2 * | 1/2008 | Patel | 166/387 |
| 7,424,928 | B2 | 9/2008 | Cox et al. | |
| 7,921,714 | B2 * | 4/2011 | Duguid et al. | 73/152.57 |
| 8,167,032 | B2 * | 5/2012 | Lumbye et al. | 166/187 |
| 8,251,140 | B2 * | 8/2012 | Ramakrishnan et al. | 166/252.1 |
| 8,322,415 | B2 * | 12/2012 | Loretz et al. | 166/250.17 |
| 8,526,269 | B2 * | 9/2013 | Kamata et al. | 367/25 |
| 2001/0018977 | A1 * | 9/2001 | Kilgore | 166/387 |
| 2004/0035634 | A1 | 2/2004 | Rueter | |
| 2006/0081412 | A1 * | 4/2006 | Wright et al. | 181/104 |
| 2009/0299637 | A1 | 12/2009 | Dasgupta | |
| 2009/0308592 | A1 * | 12/2009 | Mercer et al. | 166/134 |
| 2010/0265094 | A1 | 10/2010 | Zannoni et al. | |
| 2013/0315032 | A1 * | 11/2013 | Kamata et al. | 367/35 |

OTHER PUBLICATIONS

Garner Valley Downhole array of accelerometers, Archuleta et.al., Bulletin of the Seismological Society of America, vol. 82, No. 4, pp. 1592 1621, Aug. 1992.

* cited by examiner

METHODS, DEVICE AND COMPONENTS FOR SECURING OR COUPLING GEOPHYSICAL SENSORS TO A BOREHOLE

FIELD

Various embodiments described herein relate to the field of the acquisition of seismic data from one or more sensing devices located in a borehole, and devices, systems and methods associated therewith.

BACKGROUND

It is common in the oil and gas industry to collect data about the properties of the geologic layers within oil and gas wells by lowering sensing instruments down the well and taking measurements. Using various sensors, many different attributes of the subsurface may be measured and recorded, including electrical resistivity, conductivity, natural radioactivity, density, gravity, and temperature. Acoustic properties may be measured, and various types of seismic data collected, including VSP (Vertical Seismic Profile) data and microseismic data. It is also common when collecting seismic or microseismic data to place one or more geophones in boreholes drilled specifically for the purpose.

Some downhole sensors require that the sensor or some portion thereof be in physical contact with the sidewall of a borehole to increase coupling between the sensor and the borehole. In many cases, coupling may be achieved by pressing or clamping the sensor into firm contact with the sidewall of the borehole. Downhole sensors typically include transducers capable of sensing seismic signals such as geophones and accelerometers, which typically require good acoustic coupling to the borehole so that they may reliably and accurately receive and measure sound waves passing through adjoining geologic formations. Good acoustic coupling can sometimes be achieved by pressing the geophone into the sidewall of the borehole. This approach, however, introduces a directional variation in acoustic coupling, and therefore may not work well.

Another approach is to position an acoustic sensor centrally within a borehole while maintaining good acoustic coupling. In such an approach, for example, cement is poured into the borehole and fills the annular space between the sensor and the sidewall so that the sensor is firmly cemented in place. This provides efficient acoustic coupling between the sensor and the subsurface, and also maintains the sensor in a fixed orientation, which may be important for certain sensors.

Pouring cement into a borehole until the sensor is covered works well when a single sensor is located at the bottom of a borehole. This approach may not work so well when sensors are spaced at multiple points in a borehole, or are relatively close to the surface within a deep borehole. Conventional techniques can involve cementing sensors at such locations to achieve the desired acoustic coupling by filling almost the entire borehole with cement. There are some drawbacks to this approach, however. It is expensive, and requires more cement than would be needed just to ensure that the sensors are coupled to the sidewalls of the borehole. Moreover, for seismic or microseismic data being recorded with downhole geophones, there is a problem with noise being transmitted down the cement plug and the adjoining taut mechanical and electrical connections between adjoining downhole sensors, which together act as very efficient transducers, and pick up surface noise from well operations, roads, machinery, and the like, and broadcasting such noise deep into the subsurface.

Such noise can also be reflected back to the geophones, and may overwhelm signals from desired seismic sources, especially in microseismic recording applications where the sources are relatively weak signals originating from naturally occurring faults and fracturing operations.

What is required are systems and methods of coupling downhole sensors to boreholes that overcome the problems associated with noise generation and propagation described above.

SUMMARY

In one embodiment, there is provided a plurality of downhole geophysical sensors configured in a string, at least one of the geophysical sensors in the string being configured for securing or coupling to the sidewall of a borehole, the at least one geophysical sensor comprising at least one geophysical transducer; and an expandable member configured to be deployed into an open or expanded position when the at least one geophysical sensor is located at a desired depth in a borehole having sidewalls, at least portions of the expandable member being configured to engage at least portions of the sidewalls and prevent the passage of a securing or coupling material therearound or therethrough when the securing or coupling material is poured around or atop at least portions of the at least one geophysical sensor when the expandable member is in the open or expanded position.

In another embodiment, there is provided a method of securing or coupling at least one geophysical sensor in a string of geophysical sensors to a borehole, the at least one geophysical sensor comprising at least one geophysical transducer and an expandable member configured to be deployed into an open or expanded position when the at least one geophysical sensor is located at a desired depth in the borehole, the borehole having sidewalls, at least portions of the expandable member being configured to engage at least portions of the sidewalls to prevent the passage of a securing or coupling material therearound or therethrough when the securing or coupling material is poured around or atop at least portions of the at least one geophysical sensor when the expandable member is in the open or expanded position, comprising: lowering the string into the borehole to a desired depth; expanding the expandable member into the open position such that the expandable member engages the at least portions of the sidewall; pouring the securing or coupling material into the borehole around or atop at the at least portions of the at least one geophysical sensor, and permitting the securing or coupling material to substantially to cure or solidify in place around the at least one sensor;

Further embodiments are disclosed herein or will become apparent to those skilled in the art after having read and understood the specification and drawings hereof.

BRIEF DESCRIPTION OF THE DRAWINGS

Different aspects of the various embodiments of the invention will become apparent from the following specification, drawings and claims in which:

The drawings are not necessarily to scale. Like numbers refer to like parts or steps throughout the drawings.

DETAILED DESCRIPTIONS OF SOME EMBODIMENTS

Figure 1B:
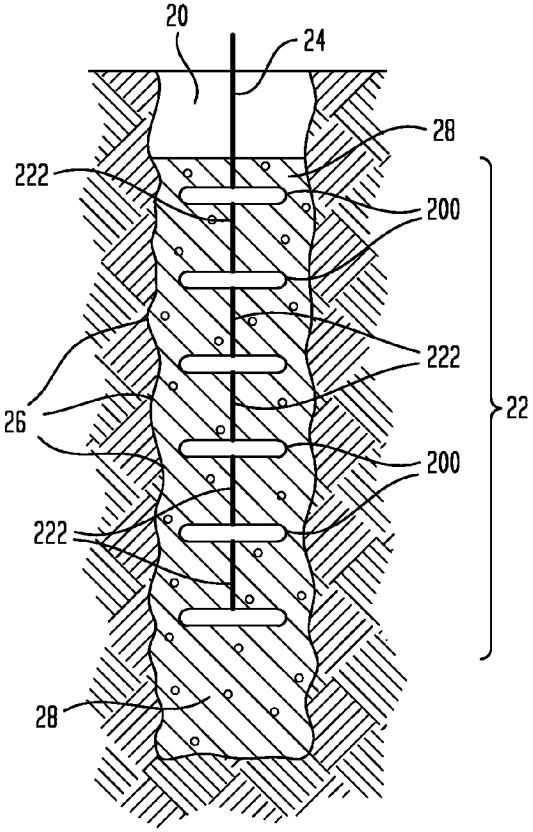
FIG. 1(b) (PRIOR ART)
FIGS. 1(*a*) and 1(*b*) illustrate prior art methods and devices for coupling seismic sensors to a borehole.

In the following description, specific details are provided to impart a thorough understanding of the various embodiments of the invention. Upon having read and understood the specification, claims and drawings hereof, however, those skilled in the art will understand that some embodiments of the invention may be practiced without hewing to some of the specific details set forth herein. Moreover, to avoid obscuring the invention, some well known methods, processes and devices and systems finding application in the various embodiments described herein are not disclosed in detail.

In the drawings, some, but not all, possible embodiments are illustrated, and further may not be shown to scale.

In the following descriptions, the term "well bore" is used generally to describe a production and/or injection well. The term "borehole" is used generally to describe a shallower hole drilled for the purpose of placing seismic sensors in the subsurface. This distinction is made because a borehole drilled for seismic sensors requires cementing to improve acoustic coupling, whereas a well bore drilled for purposes of producing hydrocarbons, injecting fracturing fluids, or the disposal of waste fluids usually is cemented to avoid contamination of the subsurface. Note that the terms "well bore" and "borehole" are interchangeable, however.

Some of the embodiments shown below may be used to secure geophones or accelerometers in a borehole to record microseismic data. Such embodiments are provided as examples, and the methods and techniques described herein may be applied to the cementing of any downhole instrumentation in a well bore or borehole.

Some downhole sensors require that the sensor or some portion thereof be in physical contact with the sidewall of borehole to ensure that the properties being measured are those of the adjoining geologic formation, as well as to ensure proper physical coupling therewith. Sensors such as geophones and accelerometers require good acoustic coupling to the well bore, or to a borehole drilled specifically for the sensors, so that sound waves passing through the adjoining geologic formations may be sensed and measured reliably and accurately. In some cases physical coupling may be achieved by pressing or clamping the sensor into firm contact with the sidewall of the borehole. Often, good acoustic coupling can be achieved by some means of pressing the geophone against the sidewall of the borehole. This approach, however, introduces a directional variation in acoustic coupling, and may not work very well.

As described above, another approach is to position a sensor centrally within a borehole while maintaining good acoustic coupling by pouring cement into the borehole, filling the annular space between the sensor and the sidewall, and surrounding the sensor with cement so that the sensor is firmly secured in place. This provides efficient acoustic coupling between the sensor and the subsurface, and also maintains the sensor in a fixed orientation, which may be important for certain sensors. For example, multi-component borehole geophones capable of measuring all three components of a seismic wave (the compressional wave and both polarizations of shear waves) are frequently used in downhole applications. Knowing their orientation is important when analyzing the data recorded with such geophones. Further, the foregoing method does not introduce any directionality into the data acquired by the sensor.

Cementing instruments in boreholes and wells is common and goes back many years. Many wells are cemented for most of their extent. This may be required for hydrocarbon production wells, and wells for injecting waste fluids into the subsurface for disposal. It is also sometimes done just for the purpose of cementing instruments, in particular seismic sensors such as geophones or accelerometers, into boreholes drilled for the purpose of placing the acoustic sensors in the subsurface.

As described above, pouring cement into a borehole until a seismic sensor is covered works well when there is a single sensor at or near the bottom of the borehole. Just enough cement may be poured into the borehole to cover the measuring sensor and ensure good coupling. This approach may not work well, however, when individual sensors are spaced at multiple points in a borehole, or are relatively close to the surface within a deep borehole. Conventional techniques may involve cementing sensors at such locations to achieve the desired acoustic coupling by filling almost the entire borehole with cement. There are some drawbacks to this approach, however. It is expensive, and requires more cement than would be needed just to ensure that the sensors are coupled to the sidewalls of the borehole.

With the recent growth of microseismic data recording the industry has become more aware of how the cementing process may introduce powerful and unwanted sources of noise into the subsurface. The cement column and the mechanical and electrical couplings and cables between adjoining sensors may act as very efficient transducers, sending noise from surface sources such as pumps, drilling platforms and generators into the subsurface, although some of this noise can reach seismic sensors directly through the subsurface. Further, the cement column may transfer such noise into the geologic layers of the subsurface, whence it may be reflected back from the interfaces between the geologic layers to the seismic sensors. Such noise can overwhelm signals from the desired seismic sources, especially in microseismic recording applications where the microseismic signal sources are relatively weak and originate from naturally occurring faults and hydraulic fracturing operations.

Some early patents describe drilling wells to dispose of waste fluids by injecting such fluids into geologic formations. For this purpose, the well must be fully cemented to avoid the possibility of contamination of the geologic layers the fluid penetrates before reaching the target geologic formation. Placing sensors in the annulus between the well bore and the pipe through which the fluids are injected, and then performing the cementing operation, ensures good coupling between the sensors and the adjacent geologic formations, but at the cost of increased noise levels.

U.S. Pat. No. 5,265,680 to Withers entitled "A method of installing instruments in wells" ("the '680 patent") describes cementing geophones in wells, but only at or near the bottom of the well. This method is adequate for one sensor housing but is not applicable when a series or string of sensor housings is positioned in the well bore. While such a method may meet the needs of the engineers who need to place an instrument permanently at the bottom of a well bore, it is generally not suitable for recording microseismic data with a string of sensors at multiple points in a borehole or well bore.

U.S. Pat. No. 5,503,225 to Withers entitled "System and method for monitoring the locations of fractures in earth formations" ("the '225 patent") shows in FIG. 1 thereof a "packer" 18 that "isolates the injection zone from the well annulus." The '225 patent describes placing sensors in an injection well in the annulus between a pipe and the walls of the well bore. One function of packer 18 is to prevent injected fracturing fluid from flowing back up the well annulus. Packer 18 also allows the cementing of sensors in the well annulus without the risk of cement flowing into the injection zone, which is hopefully part of the path through which recovered hydrocarbons will flow after the fracturing has been completed. Even if sensors are placed some distance above packer 18, cement is poured from the packer 18 all the way up past the sensors because injection wells are generally cemented to prevent high pressure fracturing fluids from leaking into other geologic layers.

U.S. Pat. No. 5,524,709 to Withers entitled "A method of coupling geophones in a borehole" ("the '709 patent") also shows "packer" 19 in FIG. 1 thereof, where packer 19 serves the same function as in the '225 patent. The '709 patent shows two "listening" boreholes drilled for the purpose of placing geophones below the surface of the earth. Such boreholes do not use a packer, and cement is shown extending uninterrupted from the bottom of the borehole to above the level of the uppermost geophone. The resulting cement plug is likely to cause unwanted noise transmission as described above.

Cementing sensors in place reduces the load on support or transmission cables interconnecting sensors, thereby reducing the risk of failure. U.S. Pat. No. 5,607,015 to Withers entitled "Method and Apparatus for installing acoustic sensors in a well bore" ("the '015 patent") does not disclose cementing sensors in a well bore or borehole, but instead shows a method of using a load-bearing cable such that sensors are not supported only by a transmission cable used to transmit signals from adjoining sensors to a recording unit. The '015 patent also shows in FIG. 1 thereof "packer" 19, which again is described as being for the purpose of isolating the injection chamber from the well annulus. In the '015 patent, packer 19 performs such a function and is not used to prevent cement from flowing into the injection chamber.

Figure 1A:
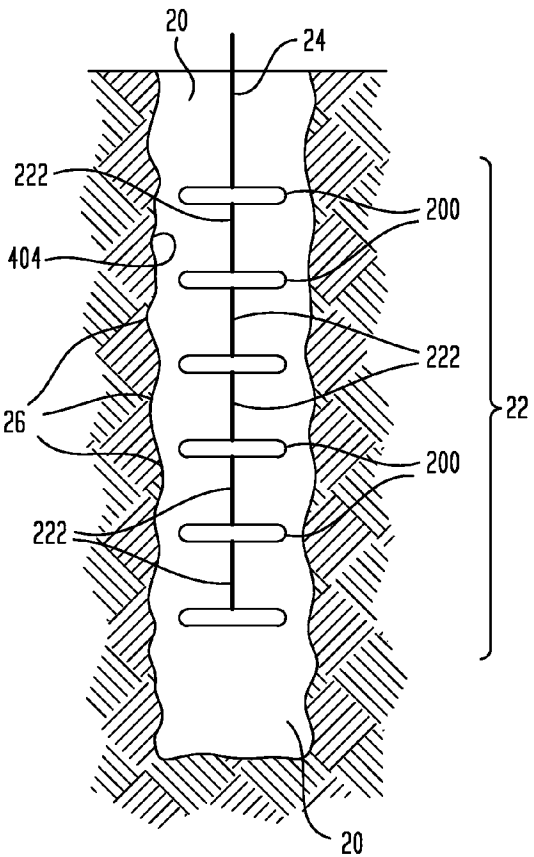
FIG. 1(a) (PRIOR ART)

Some patents in the field of microseismic data acquisition describe cementing the entire borehole. This is often unavoidable when the only available location for downhole geophones is the injection well itself. U.S. Pat. No. 5,771,170 to Withers entitled "System and program for locating seismic events during earth fracture propagation" ("the '170 patent") shows an injection well and two listening boreholes. The '170 patent describes geophone units being cemented in boreholes to enhance acoustic coupling. Such cementing is shown in FIG. 1 of the '170 patent extending from the bottom of the listening boreholes to above the highest geophone units. In the injection well, a "packer" is shown but not mentioned or numbered. While it may be impossible to avoid cementing an injection well, cement plugs in listening boreholes are potential sources of noise, and are not required for production or environmental reasons.

FIGS. 1(*a*) and 1(*b*) illustrate some of the problems in the prior art described above. For purposes of illustration, note that in FIGS. 1(*a*) and 1(*b*) the vertical scales of downhole sensor string 22 are highly compressed, while the horizontal scales thereof are exaggerated.

In FIG. 1(*a*), multiple sensors 200 of downhole geophone or sensor string 22 are interconnected by mechanical and electrical connections, which typically form linking cables 222. Sensor string 22 is inserted into borehole 20, typically via wireline or cable 24, which is configured for attachment and operable connection to control panel 11 and/or data acquisition and recording system 10. Note that the vertical surfaces formed by sidewalls 26 of borehole 20 are irregular. To lower downhole string of sensors 22 down borehole 20, the diameters of sensors 200 must be smaller than that of borehole 20 at its narrowest point. This means that sensors 200 are not in contact with sidewall 26 of borehole 20 over much of their respective lengths, and in some instances do not make contact with sidewalls 26 of borehole 20 at all, resulting in poor acoustic coupling. Optimum recording of seismic signals requires efficient acoustic coupling between sensors 200 and the subsurface geologic formation(s) through which borehole 20 has been drilled.

FIG. 1(*b*) shows a conventional method for improving sensor coupling to sidewalls 26, where sensors 200 are cemented into borehole 20 by cement 28 to produce good acoustic coupling. As described above, one problem created by cementing substantially the entirety of borehole 20 is that the resulting cement plug may act as a noise antenna to propagate and transmit surface noise into the subsurface and thus to sensors 200. Cementing substantially the entirety of borehole 20 also requires considerable time, increased costs and the use of large amounts of cement. Further, cement 28 remains in place after data collection has been completed, and will thereafter continue to broadcast surface noise that may interfere with future data collection and that may also interfere with monitoring instruments in other wells (including production wells).

Figure 2:
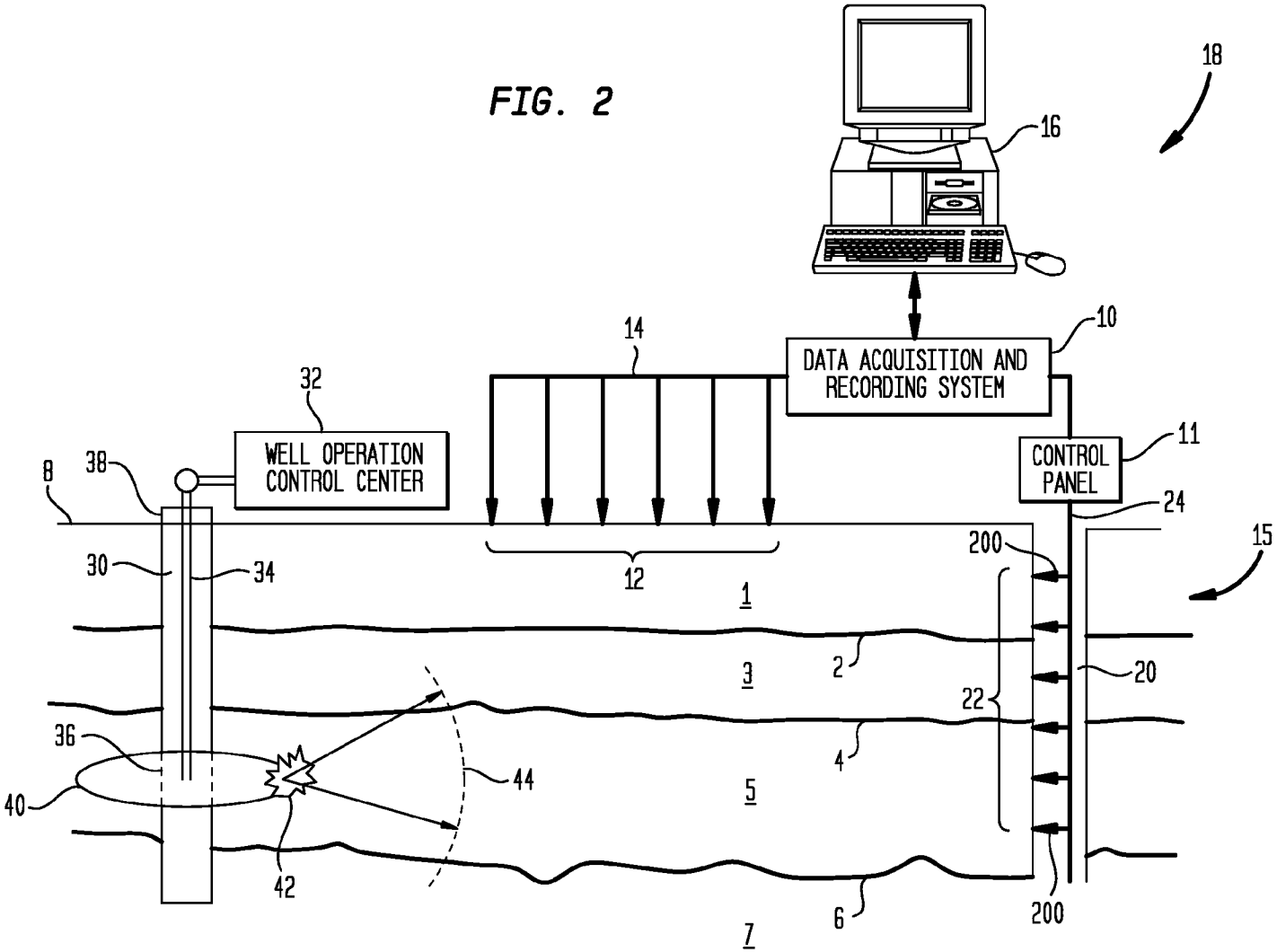
FIG. 2 shows one embodiment of a cross-sectional view of the earth and a corresponding data acquisition, recording and analysis system.

Referring now to FIG. 2 of the present patent application, there is shown a cross-sectional view of the earth in the vicinity of injection and/or production well bore 30 and listening or monitoring borehole 20, where hydraulic fracturing fluid is injected into well bore 30 and then into geologic formation 5, and seismic wavefronts and energy 44 emitted at point of fracture 42 caused by the fracturing of geologic formation 5 by the fracturing fluid are sensed by a string of downhole sensors 22 disposed in borehole 20 and/or surface sensors 12 disposed along surface 8. Note that string of downhole sensors 22 comprises a plurality of sensors 200, each of which is configured to generate output signals therefrom in response to the detection of wavefront 44 passing thereby. The electrical, magnetic, or optical analog or digital signals generated by surface sensors 12 and downhole string of sensors 22 in response to sensing seismic energy of wavefront 44 are representative of the detected or sensed seismic energy, and are recorded as seismic acquisition data by acquisition and recording system 10. According to one embodiment, control panel 11 is an instrument panel that is operably connected to downhole string of sensors 22, and is configured to provide means for controlling the operation of the expandable seals corresponding to the individual sensors of downhole sensor string 22, more about which is said below. In some embodiments, control panel 11 may be incorporated into and form a portion of data acquisition and recording system 10. Other embodiments and configurations of control panel 11 are also contemplated.

As further shown in FIG. 2, data acquisition, processing and interpretation/analysis system 18 comprises surface sensors 12 and downhole sensor string 22 operably connected to data acquisition and recording system 10, and data processing computer 16 operably connected to data acquisition and recording system 10. Note that FIG. 2 shows only one of many possible embodiments of data acquisition, processing and interpretation/analysis system 18 for acquiring, processing and interpreting/analyzing microseismic data in a well setting.

Still referring to FIG. 2, a fracturing operation is shown in progress in wellbore 30. Under the control and direction of well operation control center 32, hydraulic fracturing fluid is pumped into wellbore 30 at high pressure through pipe 34. The high pressure of the pumping operation forces fracturing fluid out of wellbore 30 through perforations 36 in wellbore 30 into hydrocarbon producing geologic formation 5. As the fracturing fluid flows outwardly from wellbore 30 and into geologic formation 5, the high pressure of the fluid fractures surrounding formation 5, causing one or more releases of seismic energy at point of fracture 42. This seismic energy propagates through subsurface 15 of the earth as a series of acoustic wavefronts or seismic waves 44, which are then sensed by surface sensors 12 and downhole string of sensors 22, converted into electrical, optical and/or magnetic analog or digital signals, and recorded by data acquisition and recording system 10 using techniques and equipment well known in the art. In data acquisition, processing and interpretation/analysis system 18 of FIG. 2, and according to one embodiment, data may be recorded, processed and analyzed or interpreted while fracturing is occurring, thereby permitting near-real-time monitoring of the fracturing process.

Data acquisition and processing configurations other than that shown in FIG. 2 may be employed. For example, only surface sensors 12 may be employed or only downhole string of sensors 22 may be employed, and downhole sensors may be employed in well bore 30 in addition to or instead of downhole sensor string 22 in borehole 20. Surface seismic sensors 12 and downhole string of seismic sensors 22 may be deployed along surface 8 and in borehole 20 and/or well bore 30. Any suitable combination of surface sensors 12 and/or downhole string of sensors 22 may be employed. By way of example, surface sensors 12 and downhole string of sensors 22 may be geophones, accelerometers, piezoelectric sensors, hydrophones, or any other suitable acoustic sensor. One-, two- or three-axis geophones may also be used in sensors 12 on surface 8 or in sensors 22 in boreholes 20 and/or 30. Downhole string of sensors 22 may be cemented in place permanently in borehole 20 or well bore 30, and thereafter used to acquire data for multiple projects. Downhole string of sensors 22 may also be lowered into borehole 20 on wireline or cable 24. The electrical, magnetic or optical signals from downhole string of sensors 22 are then transmitted to the data acquisition and recording system 10 along through wireline or cable 24. Note further that data acquisition, processing and interpretation/analysis system 18 may be employed in land, marine, off-shore rig, and transition zone settings. In addition, multiple data processing computers 16 may be employed, and/or multiple data acquisition and recording systems 10 may be employed.

Continuing to refer to FIG. 2, seismic energy 44 originating in geologic formation 5 as a result of fracturing caused by the injection of fracturing fluid into formation 5 and the expansion of the fractured zone 40 propagates within a volume of subsurface 15 of the earth through geologic formations 1, 3, 5, and 7, and is received at a plurality of surface and/or downhole sensor locations corresponding to surface sensors 12 and/or downhole string of sensors 22 located proximate a volume of subsurface 15 of the earth. Each of surface sensors 12 and the sensors contained within downhole string of sensors 22 may comprise one or a plurality of sensors, or arrays of sensors, and are typically geophones, although accelerometers and other types of electrical, magnetic and optical sensors may also be used as noted above. Note further that surface sensors 12 and the individual sensors within downhole string of sensors 22 may be 1-, 2- or 3-mutually-othogonal axis sensors, geophones, hydrophones or accelerometers configured to generate electrical, magnetic and/or optical signals proportional to the displacement, velocity or acceleration of the earth at locations corresponding to surface sensors 12 and downhole string of sensors 22, where such displacement, velocity or acceleration is caused by seismic wavefront 44 arriving at the locations of surface sensors 12 and/or downhole string of sensors 22. The electrical, magnetic or optical signals generated by surface sensors 12 and/or downhole string of sensors 22 are transmitted to data acquisition and recording system 10 by cable 14 and wireline or cable 24.

In other embodiments, signals generated by surface sensors 12 and/or downhole string of sensors 22 are transmitted by wireless transmitters to a receiver operably connected to data acquisition and recording system 10. In still other embodiments, the electrical, magnetic and/or optical signals generated by surface sensors 12 and/or downhole string of sensors 22 are stored as data in solid state or other memory or recording devices associated with one or more surface sensors 12 and/or downhole string of sensors 22. The electronic memories or recording media associated with the recording devices may be periodically collected or polled, and the data stored therein uploaded to data acquisition and recording system 10.

Other embodiments include, but are not limited to, the recording of seismic waves created by the energy released by explosive charges during the perforation of wellbore 30. When wellbore 30 is cased with a metal pipe or casing, the casing must be perforated so that oil or gas may flow into pipe 34 and thence to the surface of the earth at wellhead 38. Small explosive charges are used to perforate the casing and create perforations 36 through which oil or gas may then flow. Yet further embodiments include, but are not limited to, the recording of seismic waves created by the energy released by explosive charges placed at the very bottom or "toe" of a well, or by a "string shot" (generated by a cord-like length of explosive material placed within the well), both of which techniques are typically carried out for the purpose of developing a seismic velocity depth profile of the well.

Still other configurations and embodiments may be employed to locate, measure and analyze faults in the subsurface of the earth by microseismic detection and processing means, such as, for example, sensing, recording and analyzing seismic energy originating from naturally occurring events, such as slippage along faults, settling or tilting of the subsurface, earthquakes, and other naturally-occurring events.

Data recorded by data acquisition and recording system 10 is typically, although not necessarily, in the form of digitally sampled time series referred to as seismic traces, with one time series or seismic trace for each surface sensor 12 or each sensor contained within downhole string of sensors 22. Each value in the time series is recorded at a known time and represents the value of the seismic energy sensed by surface sensors 12 and downhole string of sensors 22 at that time. The data are recorded over a period of time referred to as the data acquisition time period. The data acquisition time period varies depending on the objective of the seismic survey. When the objective of the survey is to monitor a fracturing operation, for example, the data acquisition time period may be in hours or even days. When the objective of the survey is to acquire data associated with perforating a well, the data acquisition time period is much shorter and may be measured, by way of example, in seconds or minutes.

The rate at which data are recorded for each of the channels corresponding to each of the surface sensors 12 and the sensors contained within downhole string of sensors 22 may also be varied in accordance with the objectives of the survey, and the frequencies characteristic of the seismic energy generated at point of fracture 42, and seismic wavefront 44 as it propagates through subsurface 15 and to surface 8. For example, if frequencies less than or equal to 125 Hz are expected to be sensed or measured in acoustic wavefront 44, data may be sampled at a rate of 2.0 milliseconds ("ms") per channel to ensure aliasing does not occur. Other sample rates are also possible such as 0.25 ms, 0.5 ms, 1 ms, 4 ms, 8 ms, 16 ms, and so on.

Once the seismic data have been recorded, they must be processed and converted to produce a useful display of information. The types of data processing and the algorithms used varies depending on the type of data collected, and are familiar to those skilled in the art. The objective of processing conventional seismic data is to produce a display of the geologic formations 1, 3, 5 and 7 and corresponding interfaces 2, 4 and 6. The objective of processing microseismic data is to image and monitor the fractures produced by the hydraulic fracturing process. A substantial component of data processing typically concerns noise reduction. Methods or techniques may be implemented during the collection of the data to enhance the recorded signal or reduce the recorded noise and thereby result in a better image of the geologic formations 1, 3, 5 and 7, or better imaging of the fractures. Such techniques and methods are well known in the art and need not be elaborated on further herein.

Figure 3C:
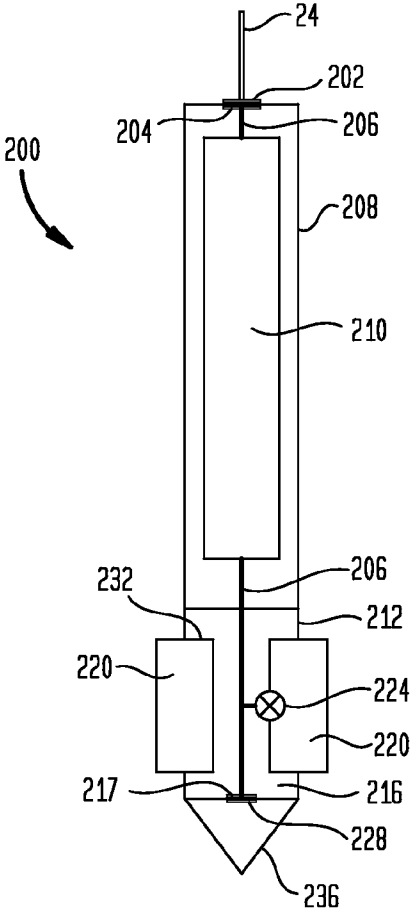
FIGS. 3(*a*) through 3 (*c*) show some embodiments of a geophysical sensor configured for coupling to a borehole.
Figure 3B:
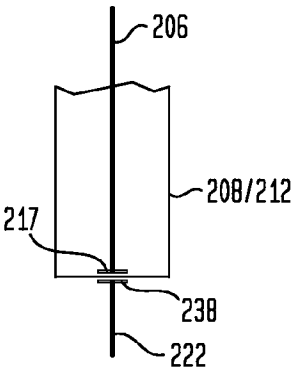
Figure 3A:
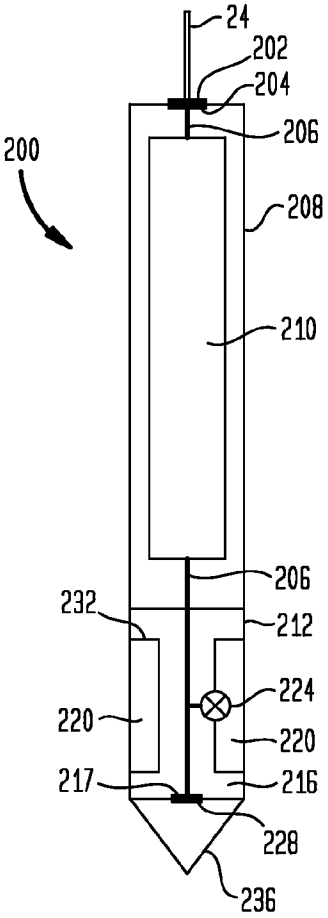

Referring now to FIGS. 3(*a*) through 3(*c*), according to some embodiments at least a portion of borehole 20 is blocked by cement 28 in proximity to one or more sensors 200 using expandable members 220 positioned around sensor housings 208 and/or 212 in downhole string of sensors 22 such that cement 28 cannot flow past and fill borehole 20 beneath a given or selected sensor 200 when cement is poured atop or around such selected sensor 200. After borehole 20 has been blocked by an expandable member 220 at the location of the selected sensor 200, just enough cement 28 is poured into borehole 20 to cover selected sensor 200 in downhole string of sensors 22 and thereby ensure good acoustic coupling of the selected sensor 200 to sidewalls 26 of borehole 20. In one embodiment, an efficient and flexible seal is provided by the expandable members 220 associated with one or more sensors 200 in string 22. Such a seal is required because the cement used to couple sensors 200 to borehole 20 is generally a relatively thin fluid when poured, and will leak past any seal that does not conform closely or substantially closely to the irregular surface of sidewall 26 of borehole 20. Expandable members 220 must also possess sufficient mechanical strength to support a column of cement 28 until cement 28 sets. This ensures good acoustic coupling of sensors 200 to borehole 20 but avoids creating an overly large column of cement in borehole 20, and thereby minimizes the transfer of noise from the surface into the subsurface. String 22 may be configured such that each of sensors 200 has an expandable member 220 associated therewith, or so that only a selected one or ones of sensors 200 in string 22 have expandable members 220 associated therewith.

As described above, a typical string of downhole sensors 22 comprises a plurality of sensors 200 located at different depths along string 22. In one embodiment, sensor housings 208 and 212 are associated with each sensor 200, and one or more of such sensors 200 include expandable members 220 that are configured to expand radially outwardly and deploy from housings 208 and/or 212 into open positions thereby to engage sidewalls 26 of borehole 20. In one embodiment, expandable members 220 are deployed into open and/or closed positions through the control of a user operating control panel 11. Note that sensors 200 may include upper housing 208 and lower housing 212 operably connected to one another, where upper housing 208 has geophysical transducer 210 disposed therewithin, and where lower housing 212 is configured to have expandable member 220 be deployed radially outwardly therefrom. Lower housing 212 may further have solenoid 224 and source of compressed air 216 disposed therewithin or operably attached thereto. Housings 208 and 212 may be integrated into a single housing, or may include yet additional housings.

Figures 5A, 5B, 5C, 5D:
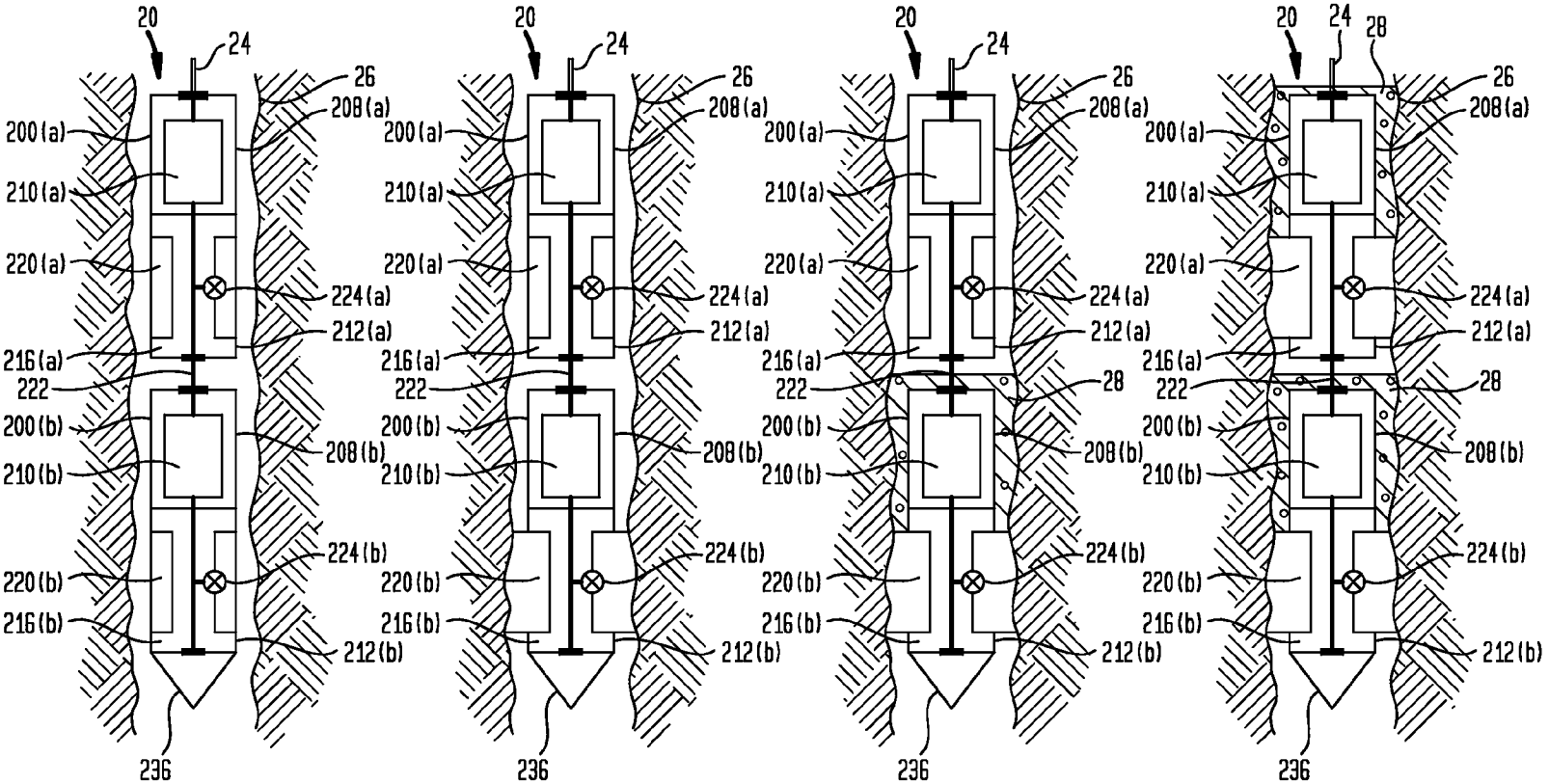

As shown in FIG. 3(*b*) and FIGS. 5(*a*) through 5(*d*), sensors 200 may be connected together by cables, and string of geophysical sensors 22 is configured to be lowered down borehole 20. According to one embodiment, string 22 and expandable members 220 are configured to block borehole 20 such that the lowermost of sensors 200 in string 22 is cemented first, followed by cementing sensors 200 located progressively higher up in borehole 20.

According to other embodiments, not all sensors 200 are fitted with expandable members 220, and cement is blocked from flowing past only selected sensors 200 of string 22. For example, according to one embodiment only the lowermost of sensors 200 is fitted with an expandable member 220 and cement is emplaced from the lowest sensor 200 to the highest sensor 200 or a higher sensor 200 in a continuous column. In another embodiment, cement is emplaced only around and above selected sensors 200 and corresponding expandable members 220

Referring now to FIGS. 3(*a*)-3 (*c*), there are shown in cross-section some embodiments of sensors 200 configured for use in string 22. In FIG. 3 (*a*), and according to some embodiments, cable 24 from control panel 11 and/or data acquisition and recording system 10 terminates in first coupling 202. Cable 24 may comprise a KEVLAR® core and electrical conductors for the transmission of electrical signals surrounded by a protective electrically insulative sheath. First coupling 202 is configured to mate or engage physically and electrically with second coupling 204 at the upper end of sensor housing 208 that contains at least one geophysical transducer 210. Internal electrical cable 206 operably connects second coupling 204 to the transducer 210. Internal electrical cable 206 terminates at third coupling 217 at the lower end of sensor housing 208.

Still referring to FIG. 3(*a*), and according to some embodiments, expandable member housing 212 of sensor 200 has a source of compressed air 216 disposed therewithin. Housing 212 itself may be configured to form a chamber for containing compressed air, or source of compressed air 216 may be a container disposed within or attached to housing 212.

According to one embodiment, and as shown in FIGS. 3(*a*) through 3(*c*), expandable member 220 is an inflatable member such as an annular tube configured to surround portions of expandable member housing 212. In the embodiment shown in FIGS. 3(*a*) and 3(*b*), expandable member 220 is operably connected to source of compressed air 216 through valve 224, the opening and/or closing of which may be controlled by a user through control panel 11. In some embodiments, valve 224 is a solenoid-operated valve and is actuated by a voltage applied through wires contained within cable 24 and internal electrical cable 206 from the surface through control panel 11. Expandable member 220 in FIGS. 3(*a*) and 3(*c*) comprises an inflatable member that in its closed position has substantially the same outside diameter as sensor housings 208 and/or 212. Moreover, expandable member 200 may be configured to fit within a circumferential or other recess 232 formed in housing 208 and/or housing 212 such that outer portions of expandable member 200 have substantially the same diameter as housings 208 and/or 212 when expandable member 200 is in a closed position; such an arrangement facilitates lowering of string 22 down borehole 20.

Continuing to refer to FIGS. 3(*a*) and 3(*c*), and according to some embodiments, expandable member 220 is inflated by sending an electrical signal to solenoid activated valve 224.

Once inflatable annular tube 220 has been inflated, tube 220 forms a seal against sidewall 26 and blocks borehole 20 below the selected sensor 200, thereby allowing cement to be poured into the borehole to cover at least portions of sensor 200 and couple same to sidewalls 26 of borehole 20.

Continuing to refer to FIGS. 3(*a*) and 3(*b*), in some embodiments third coupling 217 at the lower end of the sensor 200 may be configured to mate with or engage fourth coupling 228 at the upper end of conical member 236 to facilitate lowering sensor 200 down borehole 20. In other embodiments, and as shown in FIG. 3(*b*), sensor 200 may be connected physically and electrically to fifth coupling 238, which connects to linking cable 222, and hence to a further sensor 200 located lower in borehole 20.

Referring to FIG. 3(*c*), there is shown in cross-section expandable member 220 after valve 224 has been opened, which causes expandable member 220 (an inflatable annular tube in the embodiment illustrated in FIGS. 3(*a*) and 3(*c*)) to be deployed into an open position.

Referring to FIGS. 3(*a*) and 3(*c*), geophysical transducer 210 may be any one or more of a seismic transducer (such as a seismic sensor or a seismic source), an acoustic transducer, a geophone, an accelerometer, a piezoelectric sensor, a tilt meter, a strain gauge, an electrical resistivity electrode or sensor, an electrical electrode or sensor, a capacitive electrode or sensor, a self-potential electrode or sensor, a gravimeter, a magnetic sensor, or any other suitable type of geophysical sensor.

Note further that geophysical transducer 210 in any of sensors 200 in string 22 may be configured not only to sense selected geophysical parameters, but also to act as sources. By way of example, geophysical transducer 210 may be a piezoelectric source transducer that is configured to emit seismic source signals therefrom, which then propagate through housing 208 and cement 26 into the adjoining geologic formation(s) through which borehole 20 has been drilled. Moreover, selected sensors in string 22 may be configured to sense such source signals emitted by other sensors 200 in string 22 so as to, for example, develop a seismic velocity model in the vicinity of borehole 20. In another embodiment, geophysical sensors 210 in sensors 200 may be electrical, magnetic or capacitive electrodes that are electrically, magnetically or capactively coupled through cement 26 (or another suitable securing or coupling material, more about which is said shortly) into the adjoining geologic formation. To that end, cement 26 or other suitable securing or coupling material may be configured to provide the requisite amount of electrical conductivity, magnetic susceptibility or permeability, capacitive dielectric properties or other geophysical parameters to permit accurate measurement of electrical fields, magnetic fields, capacitance, self-potential, or other geophysical parameter, as the case may be. Note further that sensors 200 in string 22 may be configured to measure electrical resistivity or other geophysical parameters between one or more sensors 200.

For clarity, various components of sensors 200 with expandable members 220 are not shown in the Figures, including certain details of downhole string of sensors 22, certain connections to data acquisition and recording system 10, certain connections to and details concerning control panel 11, support cables, pumps, equipment associated with mixing, preparing and delivering cement 26, and other components and devices that those skilled in the art will understand are required to position and cement sensors 200 in borehole 20 and acquire data from same.

Figure 4:
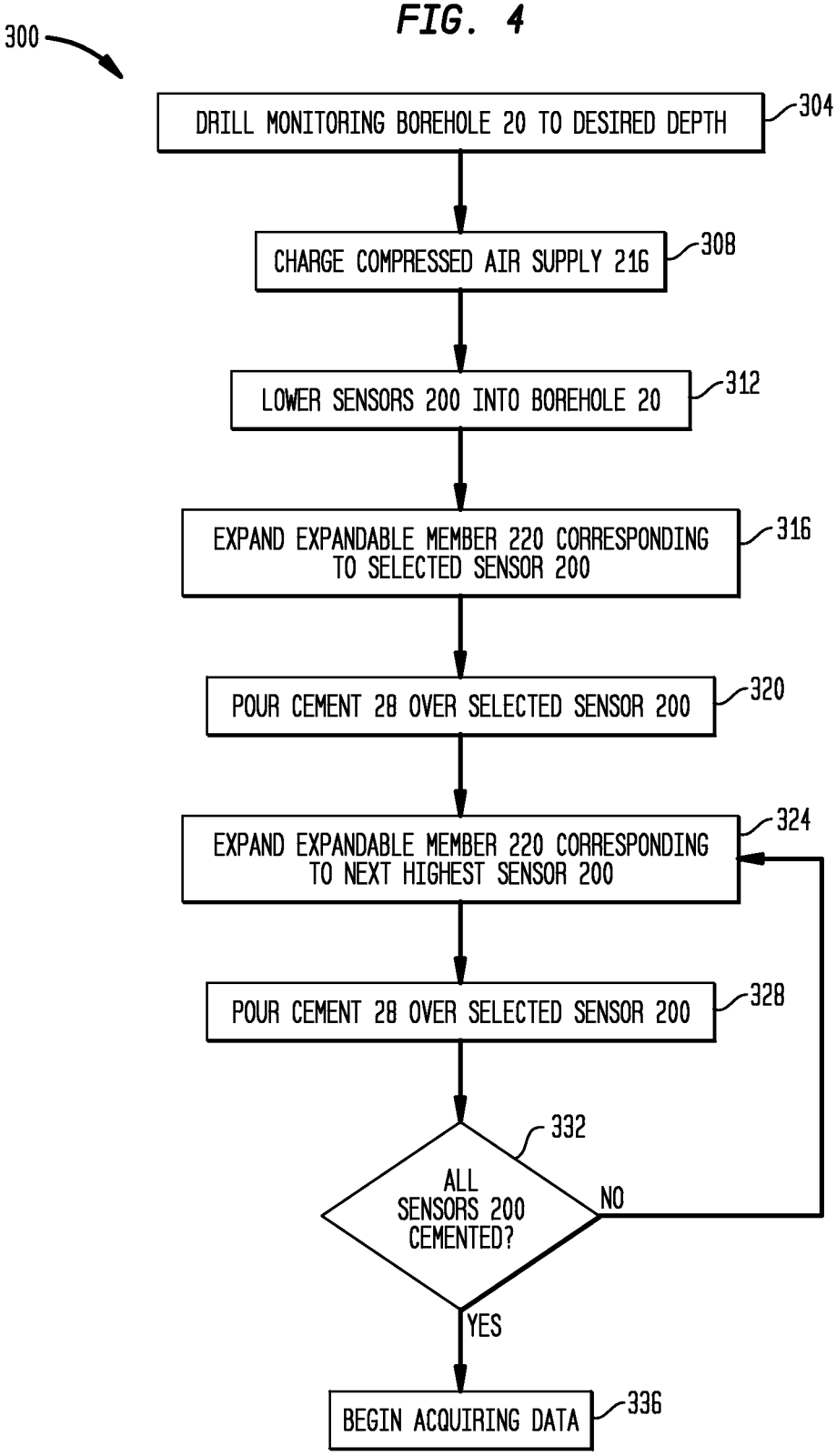
FIG. 4 shows one embodiment of a method for securing or coupling one or more geophysical sensors to a borehole, and FIGS. 5(*a*) through 5(*d*) show some embodiments of geophysical sensors 200(*a*) and 200(*b*) and illustrate a method of securing or coupling same to a borehole.

Referring now to FIG. 4, there is shown a flow chart according to one embodiment of a method 300 for coupling, securing or cementing downhole string of sensors 22. As shown in FIG. 3, at step 304 borehole 20 for downhole string of sensors 22 is drilled to a desired depth. Sources of compressed air 216 corresponding to each sensor 200 that is to be cemented to sidewall 26 are charged from a compressor or other supply of compressed air at step 308. Step 308 may be performed after, simultaneously with, or prior to, step 304. Note further that in some embodiments, compressed air may be supplied to sensors 200 from the surface after string 22 has been placed downhole in borehole 20 through air supply hoses or lines that may be incorporated into or attached to cable 24. At step 312, sensors 200 are lowered into borehole 20 until located at the desired depths. At step 316, expandable member 220 (which as described above and according to one embodiment is an inflatable annular tube) corresponding to a selected sensor 200 (which according to one embodiment is the lowest sensor 200 in string 22) is expanded or inflated to seal or substantially seal borehole 20 using source of compressed air 216 by activating solenoid controlled valve 224. An amount of cement 28 is poured into borehole 20 at step 320 that is sufficient to fill the annulus of borehole 20 around sensor 200. In some embodiments, cement 28 may also fill borehole 20 above sensor 200 to a desired height (e.g., a few feet or inches). Inflatable annular tube or other type of expandable member 220 corresponding to the next highest sensor 200 is inflated or expanded at step 324, and cement 28 is poured to cover sensor 200 at step 328. The process is repeated as shown at step 332 until all or selected sensors 200 have been cemented in place. As shown at step 336, sensors 200 are now ready to begin acquiring data.

Further steps may be included in method 300 described above. In one embodiment, the lowest sensor 200 of string 22 is cemented in place and cement 28 is allowed to set. Cable 24 is then lowered by a small distance of (e.g., several inches) to remove some tension in cable 24 before cementing occurs at the next highest sensor 200. This further reduces noise transmission from the surface of the earth down and through cable 24. In another embodiment, once all sensors 200 have been cemented in place, the orientations of three-component geophones within sensor housings 208 may be determined using techniques well known in the art, including, but not limited to, the recording of seismic signals generated by a small explosive charge, or the impact of a heavy hammer on a plate placed on the surface of the earth. Because one or more sensors 200 are cemented in place, once the orientations of the three-component geophones have been determined they remain substantially constant. In another embodiment, where the lowest sensor 200 in string 22 is proximate the bottom of borehole 20, the lowest sensor 200 may be cemented in borehole 20 without the use of a device to block the annulus of the borehole. Sensors 200 further up string 22 are then cemented in place as described above.

Note that compressed air working in conjunction with expandable or inflatable bladders or reservoirs does not constitute the only means of providing expandable members 220 in sensors 200. For example, electric motors in sensors 200 may be employed in conjunction with worm or other types of gears to open and close expandable arms or sleeves that are configured to engage sidewalls 26 and couple sensors 200 thereto. Expandable foam that hardens once expelled from a suitable container disposed within sensors 200 may also be employed to couple sensors 200 to sidewalls 26; expandable lattices or other structures may be provided in each of sensors 200 that are projected outwardly from the sensors before the expandable foam is ejected from the containers, where the lattices or other structures are configured to hold the foam in place adjacent the sidewalls until the foam hardens.

Note further that expandable members 220 need not "completely" seal the annulus of borehole 20, and instead need only provide only a degree of sealing sufficient to hold cement 28 in place until the cement—or at least most of the cement—sets. In addition, liquids which harden and set in place in borehole 20 other than cement are contemplated, such as the expandable foam described above.

Referring now to FIGS. 5(*a*) through 5(*d*), there is shown one embodiment of a method of cementing sensors 200(*a*) and 200(*b*) in borehole 20 by cementing the annulus of borehole 20 proximate selected sensors 200(*a*) and 200(*b*). According to some embodiments, sensors 200(*a*) and 200(*b*) are lowered into borehole 20 to a desired depth. In some embodiments, and as described above, expandable members 220(*a*) and 220(*b*) comprise inflatable annular tubes that surround housings 212(*a*) and 212(*b*). Housings 212(*a*) and 212(*b*) include sources of compressed air 216(*a*) and 216(*b*) and corresponding solenoid operated valves 224(*a*) and 224(*b*) that are operably connected to sources of compressed air 216(*a*) and 216(*b*) and inflatable annular tubes 220(*a*) and 220(*b*) to enable the controlled inflation of inflatable annular tubes 220(*a*) and 220(*b*). Inflatable annular tube 220(*b*) corresponding to lowest sensor 200(*b*) is inflated first using source of compressed air 216(*b*) by activating solenoid operated valve 224(*a*), thereby blocking the annulus of borehole 20.

In some embodiments, and as shown in FIG. 5(*a*), source of compressed air 216(*b*) is pressurized housing 212(*b*) of sensor 200(*b*). In other embodiments, source of compressed air 216(*b*) is a pressurized container disposed within housing 212(*b*), such pressurized container being operably connected through solenoid operated valve 224(*b*) to inflatable annular tube 220(*b*). According to some embodiments, and as discussed above, sources of compressed air 216(*a*) and 216(*b*) or pressurized containers performing the same function are charged just prior to sensors 200(*a*) and 200(*b*) being lowered into borehole 20.

Referring to FIG. 5(*b*), there is shown inflated annular tube 220(*b*) blocking the annulus of borehole 20. FIG. 5(*c*) shows sensors 200(*a*) and 200(*b*) after cement 28 has been emplaced above expandable member 220(*b*) (following expansion of such expandable member 200(*b*) in place in borehole 20), but before expandable member 220(*a*) of sensor 200(*a*) has been deployed so as to allow the emplacement of cement 28 around lower sensor 200(*b*). FIG. 5(*d*) shows sensors 200(*a*) and 200(*b*) after cement 28 has been emplaced above expandable member 220(*a*) (following expansion of such expandable member 200(*a*) in place in borehole 20), after cement has been emplaced around lower sensor 200(*b*). In FIGS. 5(*a*) through 5(*d*), cement 28 is poured into borehole 20 in two different steps according to the staged deployment of first lower expandable member 220(*b*), and second upper expandable member 220(*a*). These steps are repeated until all sensors in string 22 have been cemented in and to borehole 20.

Note that according to some embodiments, cement 28 is pumped down borehole 20 through a hose or tube having an upper end connected to a cement pump at surface 8 of the earth and a lower end positioned just above the top of lowest sensor 200 in string 22. In one embodiment, sufficient cement is poured to completely cover the lowest sensor 200. The hose is then withdrawn to a position above the next lowest sensor 200 in string 22 and the expandable member 220 corresponding thereto is deployed to ensure coupling of such sensor 200 to borehole 20. These steps are repeated until all or selected sensors 200 have been cemented to borehole 20, and the hose is then withdrawn from borehole 20.

The embodiments described herein avoid the problems of previously used approaches by cementing only the extent of borehole 20 proximate sensors 200, while leaving most of borehole 20 open to water and other fluids that do not transmit noise as effectively. This achieves a high degree of acoustic coupling of sensors 200 to borehole sidewalls 26 and adjoining geologic formations 1, 3, 5 and 7 through which borehole 20 has been drilled, but only where such acoustic coupling is desired. As shown in FIG. 5(*d*), cemented segments corresponding to sensors 200(*a*) and 200(*b*) are not physically or acoustically connected to one another, or to the surface, and therefore transmit little noise from the surface into acoustic transducers 210(*a*) and 210(*b*) in string 22 in the subsurface.

Various other embodiments of expandable members 220 are contemplated, such as: (a) expandable members operably connected to CO2 cartridges instead of compressed air; (b) comprising sets of overlapping blades configured around housings 212 that are configured to expand radially and that are operably connected to micro-motors controllable from the surface, where the overlapping blades are radially expanded and contracted by activating the micro-motors; (c) sets of overlapping, radially-expanding, spring-loaded blades that are actuated into open positions through control or operation from the surface; (d) deformable or flexible collars formed of materials such as plastic or other deformable and pliant material such as rubber and disposed around sensor housings 212, where the diameters of the collars are slightly greater than that of borehole 20; collars of varying sizes may be provided to allow seismic survey crews to adapt sensors 200 to different sizes or diameters of borehole 20.

Although the above description includes many specific examples, they should not be construed as limiting the scope of the invention, but rather as merely providing illustrations of some of the many possible embodiments of this method. The scope of the invention should be determined by the appended claims and their legal equivalents, and not by the examples given.

We claim:

1. A method of securing or coupling at least one geophysical sensor in a string of geophysical sensors to a borehole, the at least one geophysical sensor comprising at least one geophysical transducer and an expandable member configured to be deployed into an open or expanded position when the at least one geophysical sensor is located at a desired depth in the borehole, the borehole having sidewalls, at least portions of the expandable member being configured to engage at least portions of the sidewalls to prevent the passage of a securing or coupling material therearound or therethrough when the securing or coupling material is poured around or atop at least portions of the at least one geophysical sensor when the expandable member is in the open or expanded position, comprising:

lowering the string into the borehole to a desired depth;

expanding the expandable member into the open position such that the expandable member engages the at least portions of the sidewall;

pouring the securing or coupling material into the borehole around or atop at the at least portions of the at least one geophysical sensor, and permitting the securing or coupling material to substantially to cure or solidify in place around the at least one sensor.

2. The method of claim 1, further comprising providing compressed air to the expandable member.

3. The method of claim 1, further comprising deploying the expandable member from a recess disposed within the sensor from a closed or non-deployed position.

4. The method of claim 1, further comprising providing compressed air to the expandable member from a source of compressed air disposed within the at least one sensor.

5. The method of claim 1, further comprising providing compressed air to the expandable member from a source of compressed air located at the surface.

6. The method of claim 4, further comprising actuating a solenoid interposed between the expandable member and the source of compressed air to release compressed air contained therein to cause the expandable member to assume the open position.

7. The method of claim 1, further comprising providing cement as the coupling or securing material.

8. The method of claim 1, further comprising an expandable foam as the coupling or securing material.

9. The method of claim 1, further comprising coupling or securing a second sensor to the borehole after the at least one sensor has been secured or coupled to the borehole.

10. The method of claim 1, further comprising providing CO2 as the source of compressed air.

11. The method of claim 1, further comprising expanding a set of radially-expanding blades from the expandable member.

12. The method of claim 1, further comprising expanding a set of spring-loaded radially-expanding blades from the expandable member.

13. The method of claim 1, wherein the expandable member comprises at least one collar.

* * * * *